United States Patent [19]

Nozaki

[11] Patent Number: 4,512,270

[45] Date of Patent: Apr. 23, 1985

[54] HEMMING GUIDE CONTROL FOR AN OVERLOCK SEWING MACHINE

[75] Inventor: Keizo Nozaki, Kawanishi, Japan

[73] Assignee: Yamato Mishin Seizo Kabushiki Kaisha, Osaka, Japan

[21] Appl. No.: 457,208

[22] Filed: Jan. 11, 1983

[30] Foreign Application Priority Data

Sep. 27, 1982 [JP] Japan ..... 57-169318

[51] Int. Cl.[3] ..... D05B 1/24

[52] U.S. Cl. ..... 112/140; 112/177

[58] Field of Search ..... 112/140, 177, 162

[56] References Cited

U.S. PATENT DOCUMENTS

| | | | |
|---|---|---|---|
| 1,941,452 | 1/1934 | Washburn | 112/177 |
| 2,233,088 | 2/1941 | Washburn | 112/177 |
| 2,434,619 | 1/1948 | Knaus | 112/177 |

FOREIGN PATENT DOCUMENTS

| | | | |
|---|---|---|---|
| 2130377 | 12/1971 | Fed. Rep. of Germany | 112/140 |

*Primary Examiner*—Werner H. Schroeder
*Assistant Examiner*—A. M. Falik
*Attorney, Agent, or Firm*—Wenderoth, Lind & Ponack

[57] ABSTRACT

A hemming guide control for an overlock sewing machine which assures stitching of portions of the fabric to be sewn just forward of and behind a cross seam. The apparatus includes a hemming guide unit having a fabric guide surface, which is movable laterally with respect to the direction of sewing, structure for detecting the cross seam longitudinally behind the fabric guide surface, and structure, responsive to the detection of the cross seam, for moving the hemming guide unit away from the fabric to be sewn just before the stepped cross seam crosses beneath the sewing needle, and returning the hemming guide unit to its original position after the cross seam passes under the sewing needle, thereby to eliminate excessive pressure on the cross seam by the fabric guide surface along a segment of the sewing path from just forward to just rearward of the cross seam.

17 Claims, 18 Drawing Figures

HEMMING GUIDE CONTROL FOR AN OVERLOCK SEWING MACHINE

BACKGROUND OF THE INVENTION

Generally speaking, bottom hemming in the operation of a sewing machine is carried out as follows: as shown in FIG. 5A, the bottom of a fabric 34 is folded over twice and held under a fabric presser 23. A needle 37 drops at a needle drop point 22 and passes through a fabric edge 38 and a folded portion 39 just below the edge 38. The needle is continuously retracted and reinserted to provide blind stitching.

In order to provide overlock stitching, the movement of a sewing thread 40 must be as is shown by the dotted line in FIG. 5B. In this case, the sewing thread 40 should pass through the fabric edge 38 and then through a central line 41 of the folded portion 39 without turning aside to the left or to the right. When the sewing thread 40 passes through the central line 41 of the folded portion 39 without turning aside to the left or to the right, the sewing thread then turns around the fabric edge 38 to obtain overlock stitching so that the sewing thread 40 does not appear on the surface 42 (the lower surface of FIG. 5C) of the fabric 34. This is blind stitching. As seen from the oblique view of the reverse side of the fabric in FIG. 5D, the stitched portion of the sewing thread 40 as represented by dotted lines is visible on side 43 but not on side 42.

When sewing with blind stitches a plain portion of the fabric which has no stepped part on the side seam, it is possible to perform such sewing satisfactorily with the sewing thread 40 invisible on the surface 42 and with no unstitched portion in the fabric. Thus, referring to FIGS. 6A, 6B, 7A and 7B, the location of the fabric guide surface 20 of a hemming guide 5, which is to guide the folded portion 39 for blind stitching in such a way that the folded portion 39 is located exactly at a proper place relative to the needle drop point 22 in contact therewith, varies with the thickness and softness of respective fabrics.

In practice, the fabric concerned is tentatively sewn several times in order to adjust the fabric guide surface 20 very carefully so that the needle 37 can pass through the central point 41 of the folded portion 39. Once the adjustment has been made, the fabric can be sewn with blind stitches very satisfactorily even if it is continuously sewn.

When the sides of a skirt or a body are sewn together lengthwise as is illustrated in FIG. 10, the part sewn is called a stepped part on a side-seam (stepped cross seam). (See FIG. 10). In a fabric containing a stepped part 33 on a side-seam, with a fixed hemming guide so adjusted as to correspond with the fabric, when the stepped part 33 on the side-seam is just before the fixed hemming guide and is not in contact with the fabric guide surface 20, as shown in FIGS. 6A and 6B, the fabric 34 will be guided by the fabric guide surface 20 while being in contact therewith, and so will be sewn quite satisfactorily.

However, when the stepped part 33 on the side-seam has passed through an opening between a fabric contact face 8 of the fixed hemming guide and the edge of a bending guide plate 44 (see FIG. 2), and arrives at the fabric guide surface 20, as shown in FIG. 7A, it is pressed by the fabric guide surface 20, and thereby portions of the fabric just before and behind the stepped part 33 are forced to become hollow portions 35 and 36, as shown by the full line in FIG. 7B.

However, when the stepped part 33 with such hollow portions 35 and 36 advances below the fabric presser 23 and further advance to the needle drop point 22, the needle 37 will drop at a point on a needle point line 45. Thus, the hollow portions 35 and 36 remain unstitched because they do not reach the needle point line 45. This is a great disadvantage in the use of an overlock sewing machine.

In the past, trained sewing operators have each time tried by hand to vary the conditions in which the fabric 34 is guided in order to prevent such a disadvantage in weaving from occurring. But it is a great waste of time and labor to perform such a hand operation in the environment of today's super high-speed sewing. Indeed, this is a main cause of impairment of the efficiency of this kind of sewing operation.

OBJECTS OF THE INVENTION

A first object of the present invention is to provide an automatic device in a sewing machine which prevents the portions of a fabric just in front of and behind a stepped part on a side-seam from being unstitched when the stepped part comes to a needle drop point.

A second object is to provide an automatic device for detecting that the stepped part on the side-seam has approached a needle drop point.

A third object is to provide a device which automatically generates a detection signal in conformity with a detection that the stepped part on the side-seam has approached the needle point, and which moves a fabric guide surface at a proper point in conformity with such detection signal.

A fourth object is to provide a device which brings back the fabric guide surface to its original location after a certain interval of movement.

BRIEF SUMMARY OF THE INVENTION

The present invention provides a mechanism which will automatically solve the problem of prior overlock sewing machines. By making use of a cycle counter and a solenoid, it is possible to detect a moving stepped part on a side-seam just before a point where a needle drops in the sewing machine. In particular, a movable fabric guide surface is provided which is operated by a fine adjusting device and by a microswitch. By this mechanism, when the stepped part on the side-seam (cross seam) arrives at the point where the needle drops, the fabric guide surface is caused to retract to the right so that the stepped part does not come into contact with the guide surface. This removes a disadvantage of producing the hollow portions just in front of and behind the stepped part, which hollow portions would remain unstitched.

BRIEF DESCRIPTION OF THE DRAWINGS

The attached drawings show an embodiment of the invention.

DETAILED DESCRIPTION OF THE PREFERRED EMBODIMENT

Figure 1:
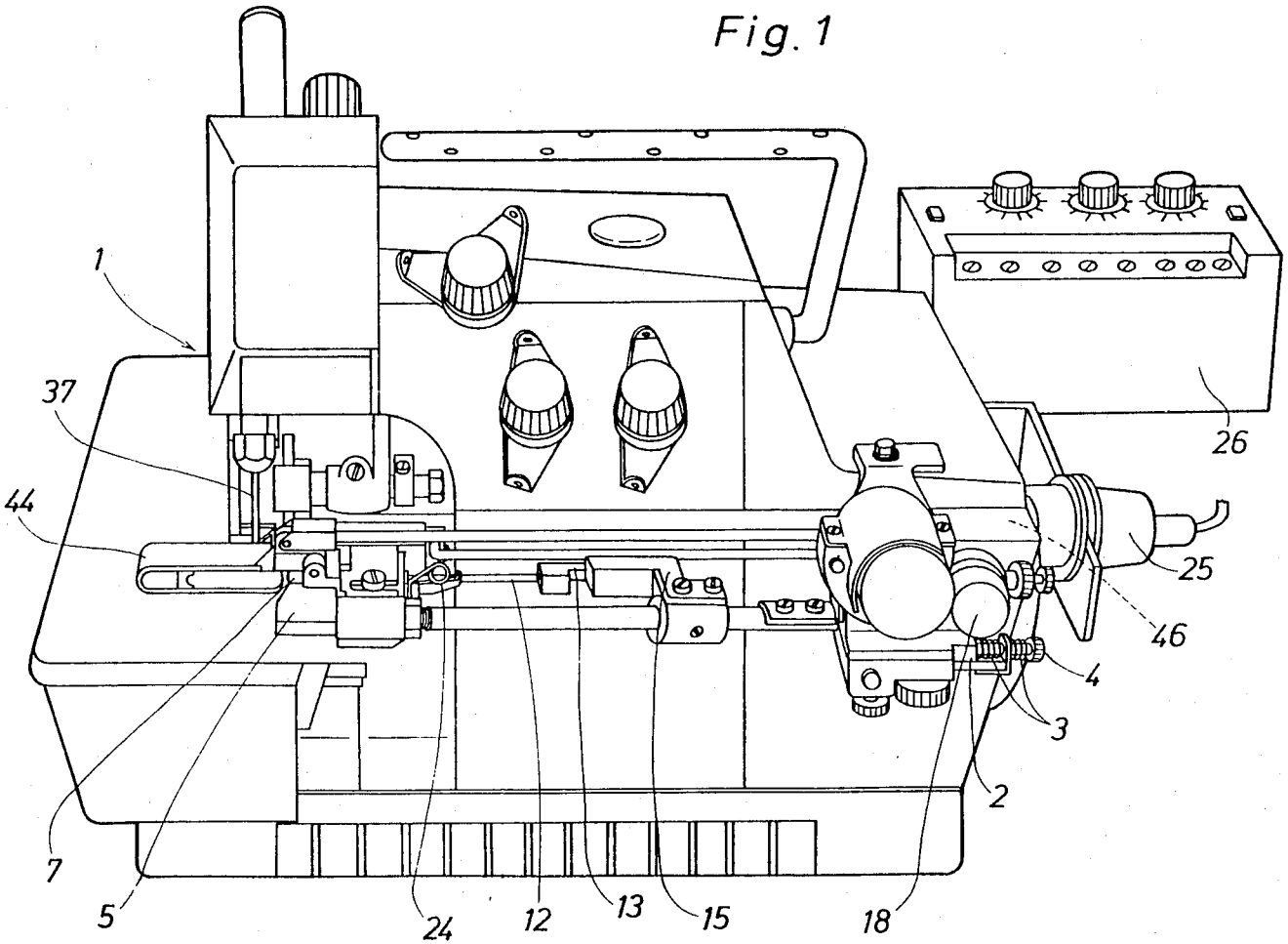
FIG. 1 is a perspective drawing of an apparatus in accordance with the invention.
Figure 2:
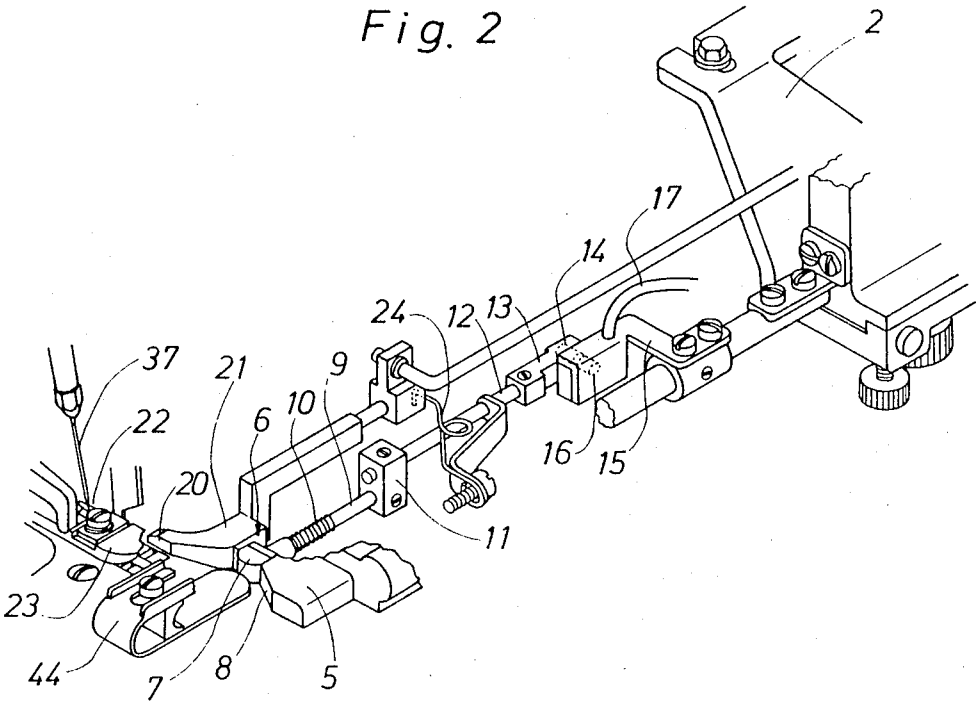
FIG. 2 is a perspective drawing of the essential elements of a main body of a hemming guide and a fabric guide surface.
Figure 3:
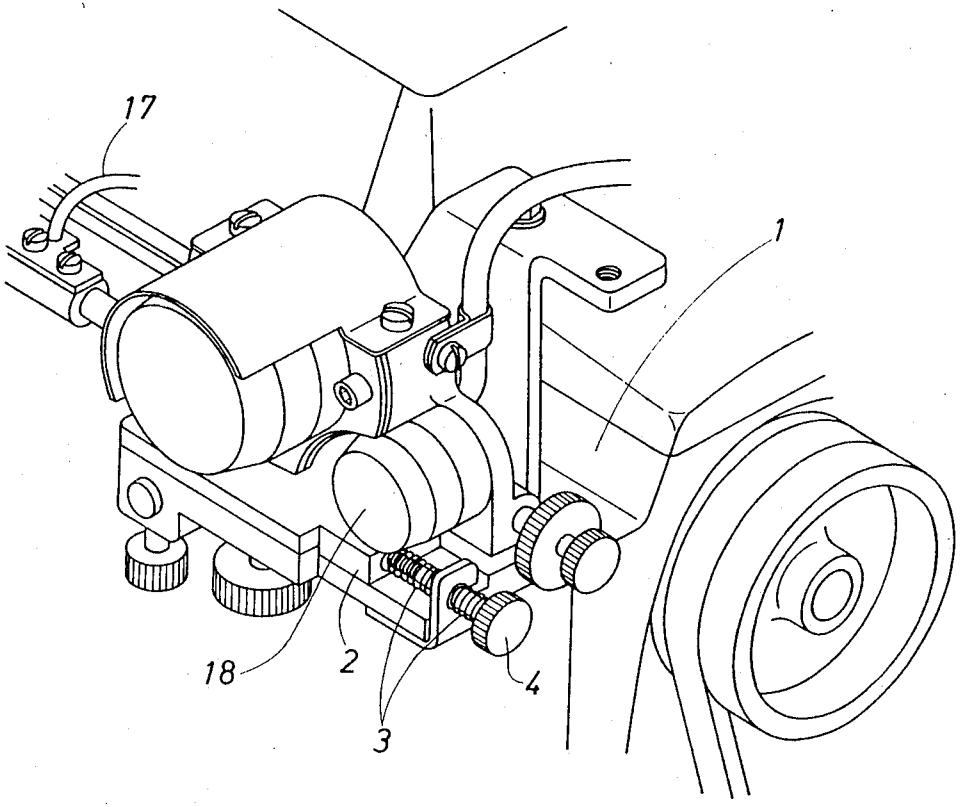
FIG. 3 is a perspective drawing showing the relationship between an installing area of the main body of the hemming guide and a sewing machine head.
Figure 4:
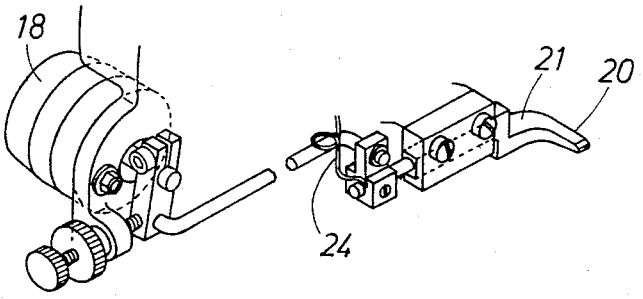
FIG. 4 is a perspective drawing showing the relationship between the fabric guide surface and a solenoid.
Figure 5A:
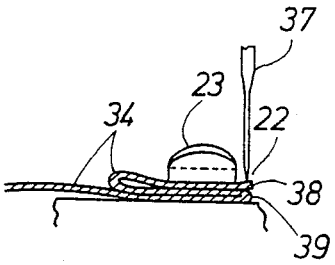
FIGS. 5A, 5B, and 5C are sectional views showing states of an ordinary bottom hemming.
Figure 5C:
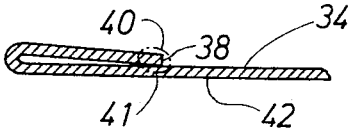
Figure 5B:
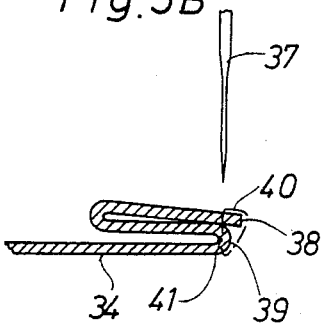
Figure 5D:
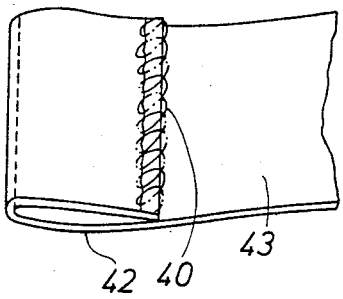
FIG. 5D is a perspective drawing showing a completed hemmed bottom portion.
Figure 6A:
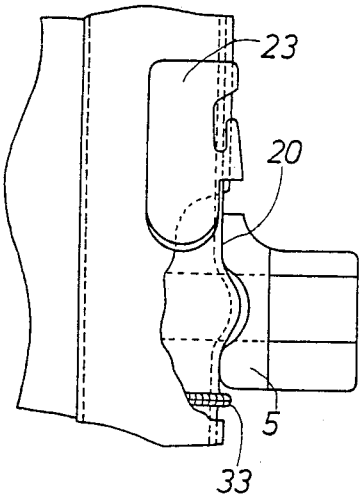
FIG. 6A is a plan view of a plain portion of a fabric being stitched by a fixed hemming guide.
Figure 6B:
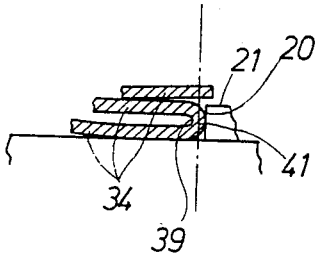
FIG. 6B is a sectional view in a similar case.
Figure 7A:
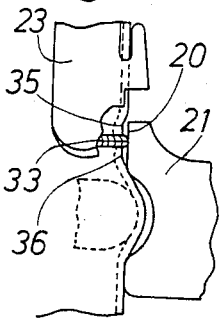
FIG. 7A is a plan view of the fabric being stitched with the stepped part on the side-seam being guided by a fixed guide.
Figure 7B:
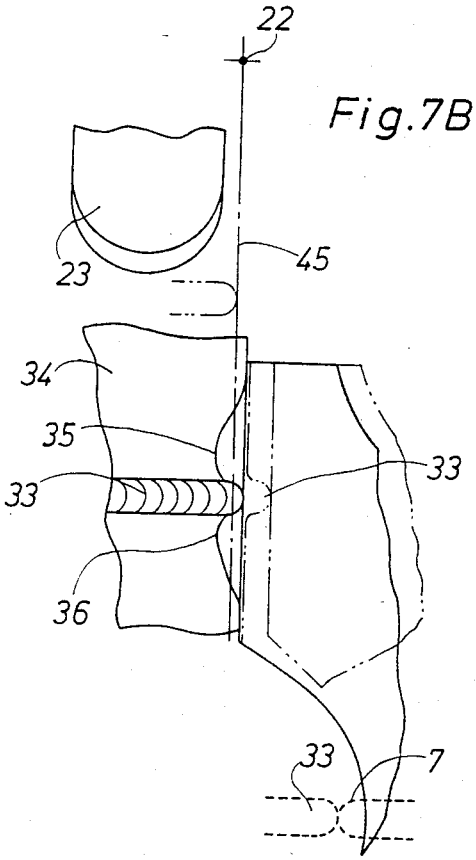
FIG. 7B is an enlarged view of the essential elements of FIG. 7A.

The present invention will now be described in detail with reference to the accompanying drawings which show an embodiment thereof.

The numeral 1 designates a sewing machine head. A blind-hemming edge guide bracket 2 is adjustably installed in a lateral position in the sewing machine head 1 by means of a lateral position adjusting screw 4 having a backlash preventing spring 3. A main body of hemming guide 5 is fixedly attached to the blind-hemming edge guide bracket 2. The numeral 6 generally designates detection components which are in the state of being slightly more projected than a fabric contact surface 8 of the main body hemming guide 5. A detection bar 9 with a contact piece 7 at one end is inserted into the main body of hemming guide 5 by means of a detection bar return spring 10. A detection bar connecting piece 11 connects the other end of the detection bar 9 with a connecting bar 12. A permanent magnet holding piece 13 is connected to the connecting bar 12. A permanent magnet 14 is attached to a side of the permanent magnet holding piece 13. A photoelectric element holding plate 15 holds a magnetism sensing element 16 in such a manner that the element 16 stands face-to-face with permanent magnet 14 and is slidable and is engageable with the permanent magnet 14. An electric cable 17 transmits electricity from a solenoid 18 furnished on the blind-hemming edge guide bracket 2 to the magnetism sensing element 16. The above components 9 through 18 constitute the detection components 6.

When a flat portion of the fabric passes by the fabric contact surface 8 of the main body of hemming guide 5 during the hemming operation, the contact piece 7 remains stationary without being affected at all. However, when a protruding stepped part on a side-seam (cross seam) of the fabric passes by the fabric contact surface 8, the contact piece 7 is pressed by the protruding stepped part and retracts to the right against the force of the detection bar return spring 10. The retraction of the contact piece 7 causes the permanent magnet 14 to retract to the right. Therefore, the state in which the permanent magnet 14 stands face-to-face with the magnetism sensing element 16 has been changed. This change is sensed by sensing element 16 and transmitted thereby via cable 17 to the solenoid 18 to urge it into operation. The solenoid 18 is also controlled by a counter device 19 whereby, after a certain interval (the number of stitches made by the counter device 19 following the transmission through cable 17 of said change), the solenoid 18 is actually operated. Here the detection bar 9 is urged to retract to the right by a detection bar return spring 10 at a moment when the stepped part 33 on the side-seam comes into contact with the contact piece 7. However, when the stepped part (cross seam) 33 passes by the contact piece 7, pressure on contact piece 7 is immediately released so that the contact piece 7 is returned to its original position by the operation of the detection bar return spring 10. Thus, there exists no unstable state during the interval, and there is scarcely any possibility that vibration of the sewing machine or any other external condition might cause the detection components 6 to operate inaccurately. Thus, the detection components 6 are able to accurately detect the leading and rear edges and the width of the stepped part on the side seam. The fabric guide surface 20 is at one end of the fabric guide unit 21 which is slidably inserted in the main body of hemming guide 5, and is located just in front of the fabric presser 23, which send the fabric as it is to the needle fabric guide unit 21 which is slidably inserted in the main body of hemming guide 5, and is located just in front of the fabric presser 23, which send the fabric as it is to the needle drop point 22. One end of the fabric guide unit 21 is allowed to move forward and backward by the solenoid 18.

When the fabric guide unit 21, which has been pulled and retracted to the right by the solenoid 18, is released from its pulling by the operation of a counter 28 provided for moving the fabric back to the left, a return spring 24 will immediately urge fabric guide surface 20 to the left to return the fabric guide surface 20 to its original position.

As the flat portion of the fabric advances to the needle drop point, the end of the fabric must be guided as accurately as possible. Otherwise, blind stitches will appear on the right surface of the fabric after the fabric is completely sewn, and so will injure the fabric appearance.

When the stepped part 33 on the side-seam advances to the needle point, if the fabric guide surface 20 is just at the same position as the position at which it is placed when the flat portion of the fabric passes by, hollow portions produced just before and after the stepped part 33 will remain unstitched. In order to prevent this, therefore, the fabric guide surface 20 is caused to retract to the right. Thus, the time during which the fabric guide surface 20 is not at its original point, should be the minimum required time since during such time the fabric guide surface 20 does not guide the fabric in the normal manner.

If the guide surface were retracted to the right immediately after the detection components 6 detect the stepped part 33 on the side-seam, a flat portion of the fabric just before the stepped part 33 would not be guided properly while the stepped part 33 advances from the contact piece 7 to the starting point of the fabric guide surface 20. Also, if the fabric guide surface 20 which has been so retracted to the right remains there for some time after the stepped part 33 has passed by the fabric guide surface 20, the flat portion following the stepped part 33 would not be properly guided. In either case, as there is no accurate guidance, unsatisfactory blind stitches would tend to be produced.

The present invention is provided with the cycle counter 26 which previously computes for each type of fabric the interval (the number of stitches) required for the stepped part 33 on the side-seam to advance just in front of the starting point of the fabric guide surface 20 after it has come into contact with the contact piece 7, and also the interval (the number of stitches) required for the stepped part to advance to just behind the end point of the fabric guide surface 20 after it has come into contact with the fabric contact piece 7; and previously sets such computed intervals in its counters 27 and 28, respectively, so as to be operated by the solenoid 18.

Thus, the fabric guide surface 20 is just at the position of retracting to the right only for a moment when the stepped part 33 passes by the fabric guide surface 20, so that the flat portion of the fabric is properly guided to obtain good blind stitches.

Figure 9:
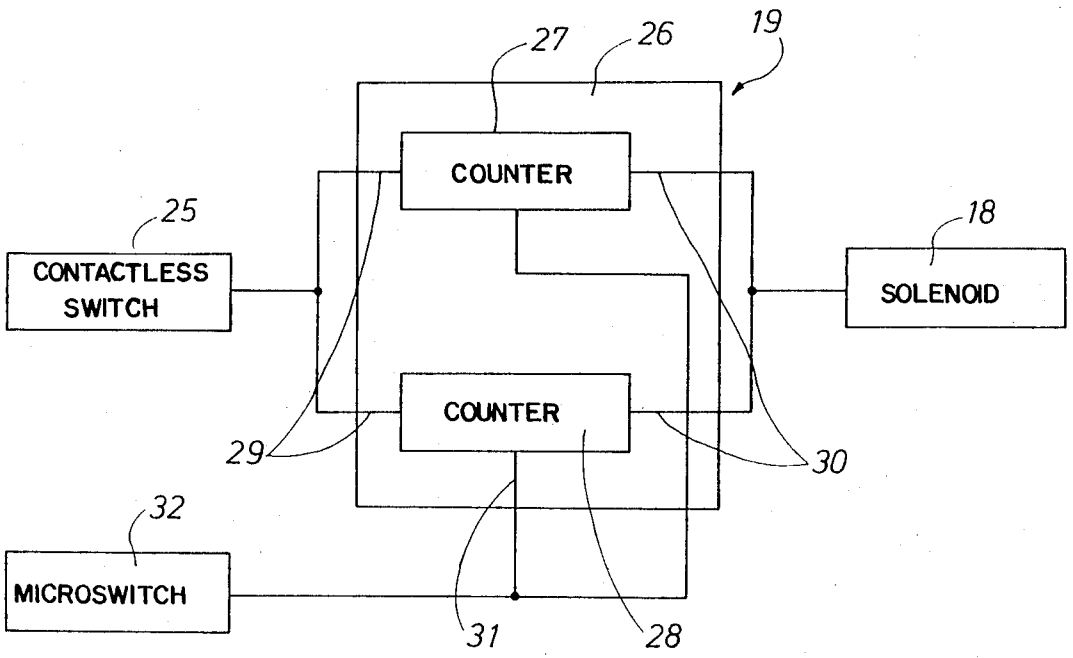
FIG. 9 is a block diagram of an electrical circuit in accordance with the invention.
Figure 10A:
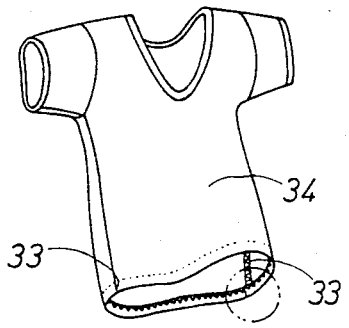
FIG. 10A is a perspective drawing of a sewn article.
Figure 10B:
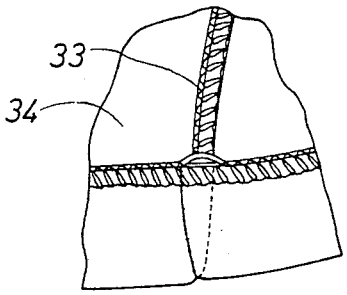
FIG. 10B is a drawing showing the essential sewn portions of the sewn article.

The electrical elements, such as the counters and the solenoid, are conventional. As shown in FIG. 9, the numeral 25 designates a conventional contactless switch, such as the TL-X(P)5 contactless switch manufactured by Takeishi Electrical Co., Ltd. of Japan, for the counters 27 and 28. A conventional cycle counter 26, such as the KCR-1000 cycle counter manufactured by Koyo Electronic Industry Co., of Japan, reads the number of switch operations for detecting, and performs switch operations for other power supply sources, for whatever number of counts is shown on the knob of the sewing machine head which is set for the particular fabric being sewn. The contactless switch 25 is connected to input terminals 29 for the counter 27 which shifts the fabric guide surface 20 to the right and for the counter 28 for moving surface 20 back to the left, respectively. The solenoid 18, such as the 24 volt MD-191ZF solenoid of Maruha Electrical Machinery Co. of Japan, is connected to output terminals 30. A conventional microswitch 32, such as the VV-5-1A44 microswitch of Takeishi Electrical Co., Ltd. of Japan, responsive to the movement of contact piece 7, is electrically connected to a control terminal 31 for the counter 28 for moving back surface 20 to the left and to the counter 27 for shifting surface 20 to the right. The contactless switch 25 gives one signal for every rotation of the sewing machine, and always gives its signals to the input terminals 29 for both the counter 27 and the counter 28.

Now, one rotation of the sewing machine corresponds to one stitch in sewing. Thus, when the stepped part 33 on the side-seam pushes contact piece 7 of the detection components 6, the mircoswitch 32 is shifted from the "OFF" position to the "ON" position. Then, the counting of the counter 27 starts, and when the number of stitches previously set in the counter 27 is detected, the solenoid 18 begins operating to move the fabric guide surface 20 of the main body of hemming guide 5 to the right. Even if microswitch 32 is placed in the "OFF" position, the counter 27 operates normally by the operation of a self-maintenance circuit within the counter 27.

When the stepped part 33 passes by the contact piece 7 and returns to its original position by the operation of the detection bar return spring 10, and when the microswitch is shifted from the "ON" position to the "OFF" position, the counting of the counter 28 starts; and when the number of stitches previously set in the counter 28 is detected, electric current to the solenoid 18 is cut off and the fabric guide surface 20 is returned to its original position, i.e., the position at which the flat portion of the fabric is guided. At the same time the self-maintenance circuit within the counter 27 is placed in the "OFF" position.

Figure 8A:
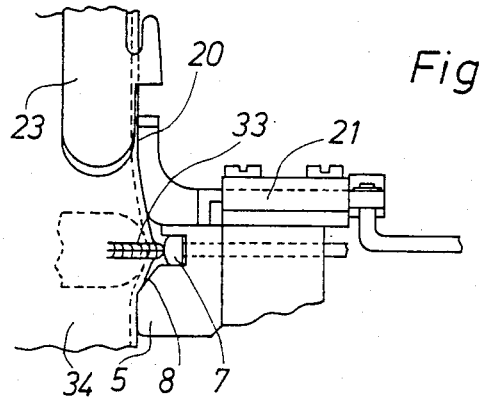
FIGS. 8A, 8B, and 8C are sketches illustrating the principle of sewing by means of the present apparatus.
Figure 8B:
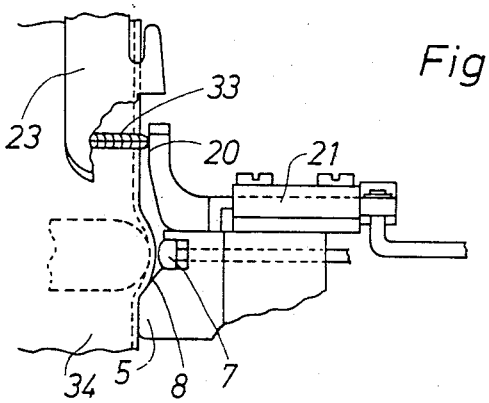
Figure 8C:
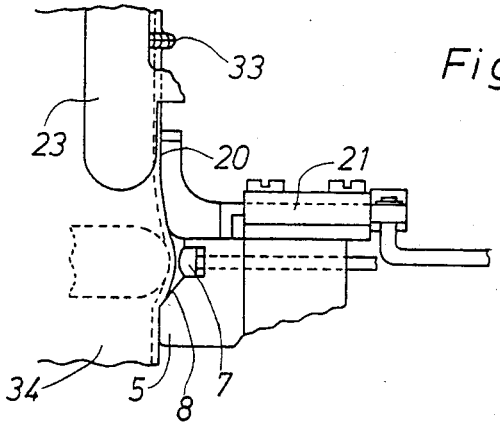

The structure of the present invention is as has been described above. When the cycle counter 26 is connected to a power source and when the stepped part 33 on the side-seam reaches the contact piece 7, as shown in FIG. 8A, the stepped part 33 pushes the contact piece 7, and the microswitch 32, operating in relation to the contact piece 7, simultaneously operates the solenoid 18, and the guide surface 20 connected to the solenoid 18 is thereby caused to move to the right, as shown in FIG. 8B, so that a suitable space is created for the passage of the stepped part 33. Thus, the stepped part 33 is properly sent under the fabric presser 23 under such conditions that the stepped part 33 is not pressed by the fabric guide surface 20, and that the hollow portions 35 and 36 just in front of and behind the stepped parts 33 are not produced, and that the needle point line 45 does not leave the fabric 34, and thereby the portions of the thread just in front of and behind the stepped part 33 can be prevented from leaving the seam.

Simultaneously with this operation, a switch on the cycle counter 26 is placed in the "ON" position and after the certain number of stitches previously set in the counter 28, the switch is cut off by the operation of the contactless switch 25 and a contact point 46 which is in the inner side of a machine pulley, and so the solenoid returns to its original position and at the same time the fabric guide surface 20 is returned to its original position by the return spring 24. Thus, the above parts return to their normal positions in which sewing is performed.

In the present invention, as has been stated above, electrical automatic operations do away with any special manual operations by a sewing operator in connection with a stepped part on the side-seam. All that the operator is required to do is merely to connect the cable 17 to a power source, and the contact piece 7 in the blind-hemming edge guide detects the stepped part 33 and causes the fabric guide surface 20 to be retracted temporarily to the right so that the stepped part 33, as well as the portions just before and after it, can be sewn properly without any portion being unstitched.

The present invention saves labor and time in sewing hemming edges and enables even an unskilled operator to operate a high-speed sewing machine. Additionally, the present invention improves operational efficiency and produces superior products.

In the embodiment of the present invention, the main body of the hemming guide is separated from the fabric guide surface, which is slidably attached to the sewing machine head. However, it is possible to construct the main body of the hemming guide and the fabric guide surface as an integral unit body; and in moving the guide surface to the right or to the left, it may be possible to move the guide surface, together with the main body, to the right or to the left. In this connection, it may be said that the fabric contact surface 8 of the main body of the hemming guide 5 acts as a preparatory guide to bring the fabric into contact with the guide surface satisfactorily. Thus, it makes no difference in operation or in effects whether the two parts are separated from each other or are constructed as an integral unit body.

It is also to be noted that in practicing the present invention, it is possible to substitute any of a photoelectric element sensor, a differential translation sensor, a moiré senser and a strain gauge sensor for the magnetism sensing element 16.

What is claimed is:

1. An apparatus for assuring stitching of portions of a fabric just forward of and behind a stepped cross seam in a sewing path, which cross seam extends in a lateral direction out of the plane of the fabric, for use in a sewing machine which includes a sewing needle and means for moving the portion of the fabric to be sewn in a longitudinal direction beneath the sewing needle, said apparatus comprising:

a hemming guide unit having a fabric guide surface for being positioned adjacent the needle such that said fabric guide surface guides the portion of the fabric to be sewn in contact therewith beneath the needle, said hemming guide unit being movable between a first normal position, in which said fabric guide surface guides the fabric, and a second position laterally spaced from said first position;

means for detecting the stepped cross seam longitudinally behind said fabric guide surface; and means, responsive to the detection of the stepped cross seam, for moving said hemming guide unit from said first normal position in a first direction so as to move said fabric guide surface away from the fabric to be sewn just before the stepped cross seam crosses beneath the sewing needle, and returning the hemming guide unit to said first normal position just after the stepped cross seam passes under the sewing needle, so as to eliminate excessive pressure on the stepped cross seam by the fabric guide surface along a segment of the sewing path from just forward to just rearward of the stepped cross seam.

2. Apparatus as in claim 1, wherein said detecting means includes means, responsive to the movement of the cross seam past a location longitudinally behind said fabric guide surface, for detecting the leading and rear edges and width of the cross seam as measured in the longitudinal direction;

said moving means including means for automatically moving said hemming guide unit in said first direction so as to move said fabric guide surface away from the fabric after the fabric has moved a first predetermined longitudinal distance after the detection of passage of the leading edge past said location, and means for automatically returning said hemming guide unit to said first normal position after the fabric has moved a second predetermined longitudinal distance after the detection of passage of the rear edge past said location.

3. Apparatus as in claim 1, wherein said detecting means includes means, responsive to the movement of the cross seam past a location longitudinally behind said fabric guide surface, for detecting passage of the longitudinally leading and rear edges of the cross seam past said location, and counting the number of stitches sewn by the sewing needle while the cross seam is moving past the location, said moving means including means for automatically moving said hemming guide unit so as to move said fabric guide surface in said first direction a first predetermined number of stitches after the detection of passage of the leading edge past said location, and means for automatically returning said hemming guide unit to said first normal position a second predetermined number of stitches after the detection of passage of the rear edge past said location.

4. An apparatus as in claim 3, further comprising means for manually presetting at least one of said first and second predetermined numbers.

5. An apparatus as in claim 1, wherein said detecting means includes a contact member disposed longitudinally behind said fabric guide surface for contacting the cross seam as it moves longitudinally therepast, said contact member being movable laterally away from the plane of the fabric in response to contact with the cross seam.

6. An apparatus as in claim 5, wherein said contact member is mounted to the sewing machine so as to be pushed laterally by the cross seam as it passes thereby.

7. An apparatus as in claim 5, wherein said detecting means further comprises a detection bar extending laterally away from and movable with said contact member, a magnet mounted to the end of said detection bar furthest from said contact member for lateral movement therewith, a magnetic sensing element generally face-to-face with said magnet for detecting lateral movement of said magnet; and means, responsive to the output of said sensing element and including a solenoid, for laterally moving said hemming guide unit between said first and second positions.

8. An apparatus as in claim 5, further comprising:

a lateral position adjusting screw;

a blind-hemming edge guide bracket for being adjustably positioned in the head of the sewing machine by said adjusting screw;

a hemming guide main body fixed in said blind-hemming edge guide bracket;

a detection bar return spring, said detecting means being attached to said main body through said detection bar return spring biasing said detecting means toward said first normal position;

a hemming guide unit return spring; and a fabric presser, said hemming guide unit being sliding mountable to said main body near said fabric presser laterally in front of the drop point of the needle with said hemming guide unit return spring biasing said hemming guide unit return spring toward the needle.

9. Apparatus as in claim 5, wherein said detecting means further comprises:

a detection bar extending laterally away from and movable with said contact member;

means, including a photo-electric element sensor, located at the end of said detection bar furthest from said contact member, for detecting lateral movement of said bar; and means, responsive to the output of said sensor and including a solenoid, for laterally moving said hemming guide unit between said first and second positions.

10. Apparatus as in claim 5, wherein said detecting means further comprises:

a detection bar extending laterally away from and movable with said contact member;

means, including a differential translation sensor, located at the end of said detection bar furthest from said contact member, for detecting lateral movement of said bar; and means, responsive to the output of said sensor and including a solenoid, for laterally moving said hemming guide unit between said first and second positions.

11. Apparatus as in claim 5, wherein said detecting means further comprises:

a detection bar extending laterally away from and movable with said contact member;

means, including a a moiré sensor, located at the end of said detection bar furthest from said contact member, for detecting lateral movement of said bar; and means, responsive to the output of said sensor and including a solenoid, for laterally moving said hemming guide unit between said first and second positions.

12. Apparatus as in claim 5, wherein said detecting means further comprises:

a detection bar extending laterally away from and movable with said contact member;

means, including a strain gauge sensor, located at the end of said detection bar furthest from said contact member, for detecting lateral movement of said bar; and means, responsive to the output of said sensor and including a solenoid, for laterally moving said hemming guide unit between said first and second positions.

13. An apparatus as in claim 5, wherein said detecting means includes a photo-electric element sensor, for detecting lateral movement of said contact member.

14. An apparatus as in claim 5, wherein said detecting means includes a differential translation sensor, for detecting lateral movement of said contact member.

15. An apparatus as in claim 5, wherein said detecting means includes a moiré sensor, for detecting lateral movement of said contact member.

16. An apparatus as in claim 5, wherein said detecting means includes a strain gauge sensor, for detecting lateral movement of said contact member.

17. An apparatus for assuring stitching of portions of a fabric just forward and behind a stepped cross seam in a sewing path, which cross seam extends in a lateral direction out of the place of the fabric, for use in a sewing machine which includes a sewing needle and means for moving the portion of the fabric to be sewn in a longitudinal direction beneath the sewing needle, said apparatus comprising:

a hemming guide unit having a fabric guide surface for being positioned adjacent the needle such that said fabric guide surface guides the portion of the fabric to be sewn in contact therewith beneath the needle, said hemming guide unit being movable between a first normal position in which said fabric guide surface guides the fabric, and a second position laterally spaced from said first position;

means for detecting the cross seam before it is stitched by the needle; and means, responsive to the detection of the cross seam, for moving said hemming guide unit from said first normal position away from said fabric to said second position before the cross seam reaches the needle so as to eliminate excessive pressure on the cross seam by the fabric guide surface, and returning said hemming guide unit to said first normal position after a presettable number of stitches by the needle, the stitches extending longitudinally completely over the cross seam.

* * * * *